United States Patent [19]

Figiel et al.

[11] Patent Number: 4,683,017

[45] Date of Patent: Jul. 28, 1987

[54] METHOD AND APPARATUS FOR FORMING A LOOP WITH END-GRIPPED STRAP

[75] Inventors: Janusz Figiel, Chicago; Donald Tremper, Mt. Prospect; Peter Lems, Wilmette, all of Ill.

[73] Assignee: Signode Corporation, Glenview, Ill.

[21] Appl. No.: 801,605

[22] Filed: Nov. 25, 1985

[51] Int. Cl.[4] ..... B32B 31/16

[52] U.S. Cl. ..... 156/73.1; 53/589; 100/2; 100/4; 100/33 PB; 156/73.5; 156/157; 156/468; 156/502; 156/580.1

[58] Field of Search ..... 53/589; 100/2, 4, 33 PB; 156/73.1, 157, 468, 502, 579, 580.1, 73.5

[56] References Cited

U.S. PATENT DOCUMENTS

| | | | |
|---|---|---|---|
| Re. 31,353 | 8/1983 | Cheung | 100/4 |
| 3,749,622 | 7/1973 | Sato et al. | 156/157 |
| 3,783,575 | 1/1974 | Angenendt | 53/589 X |
| 4,077,313 | 3/1978 | Lems et al. | 100/2 |
| 4,079,667 | 3/1978 | Lems et al. | 100/2 |
| 4,378,262 | 3/1983 | Annis | 156/73.5 |
| 4,482,421 | 11/1984 | Gurak | 156/580.1 |

FOREIGN PATENT DOCUMENTS

| | | |
|---|---|---|
| 2403261 | 7/1975 | Fed. Rep. of Germany . |
| 49-4520 | 2/1974 | Japan . |
| 936718 | 9/1963 | United Kingdom . |

*Primary Examiner*—Robert A. Dawson

*Attorney, Agent, or Firm*—Dressler, Goldsmith, Shore, Sutker & Milnamow

[57] ABSTRACT

A method and apparatus is provided for gripping a strap segment with two gripping members, for moving the gripping members together in a closed path to form a primary loop in the strap around at least one of the gripping members, and for feeding the strap to expand the primary loop to an expanded loop having a larger size for accommodating an article to be bound by the strap.

26 Claims, 26 Drawing Figures

FIG. 5
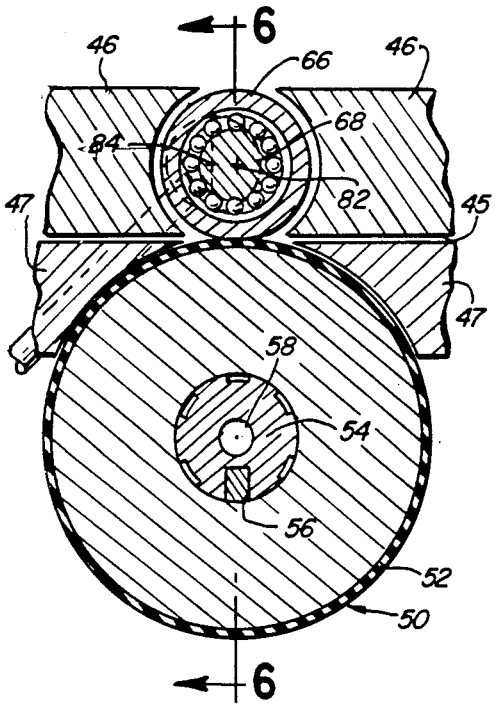
FIG. 6
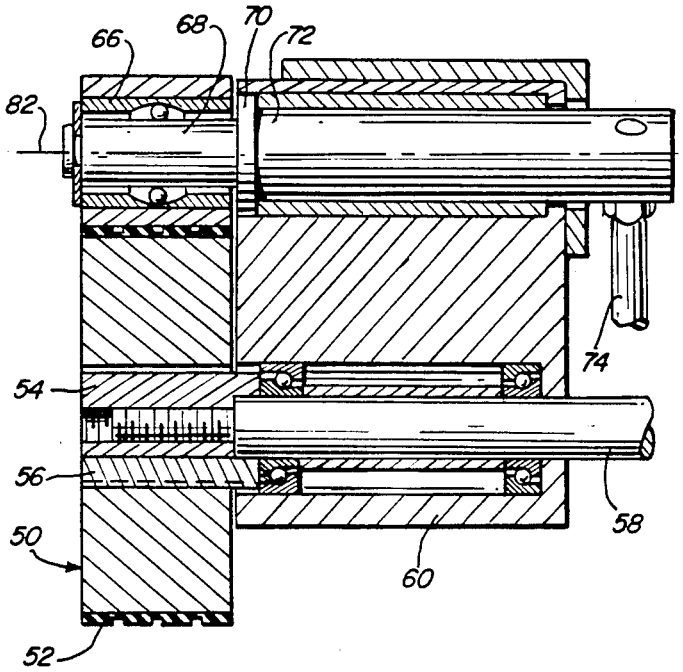
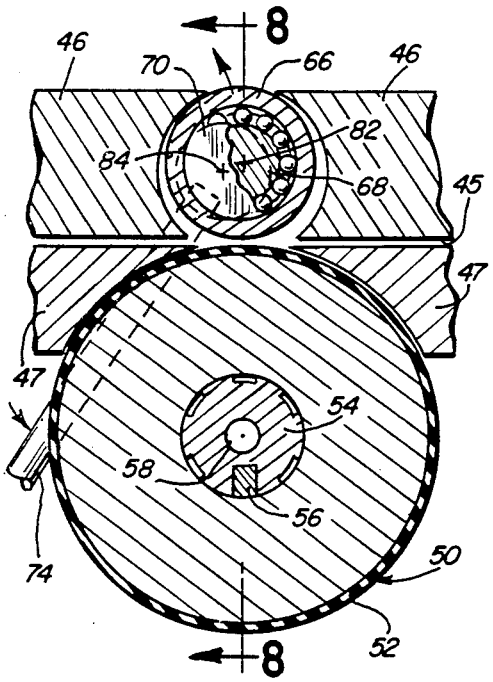
FIG. 7
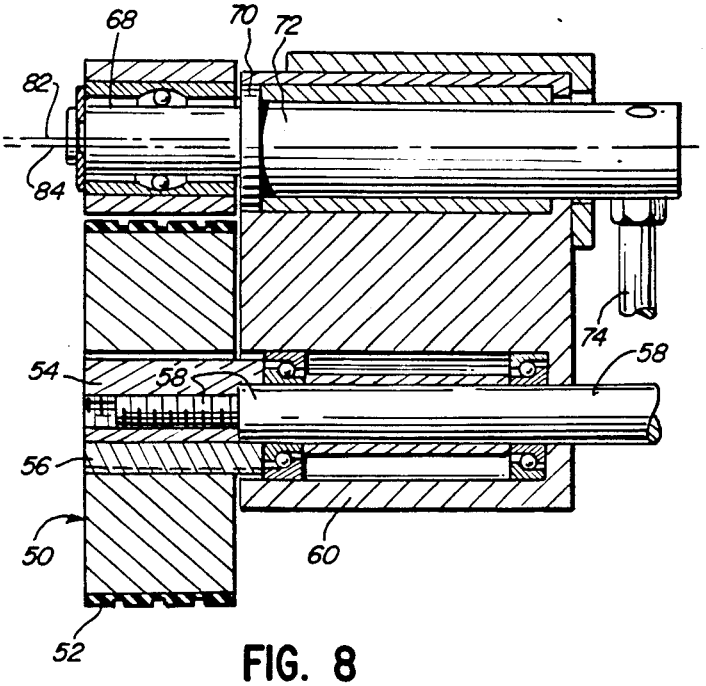
FIG. 8

10
11
12
100
101
102
103
104
105
106
107
110
112
114
116
118
120
124
132
134
138
140
142
143
151
152
153
154
155
161
162
163
165
166
167
168
169
170
172
28

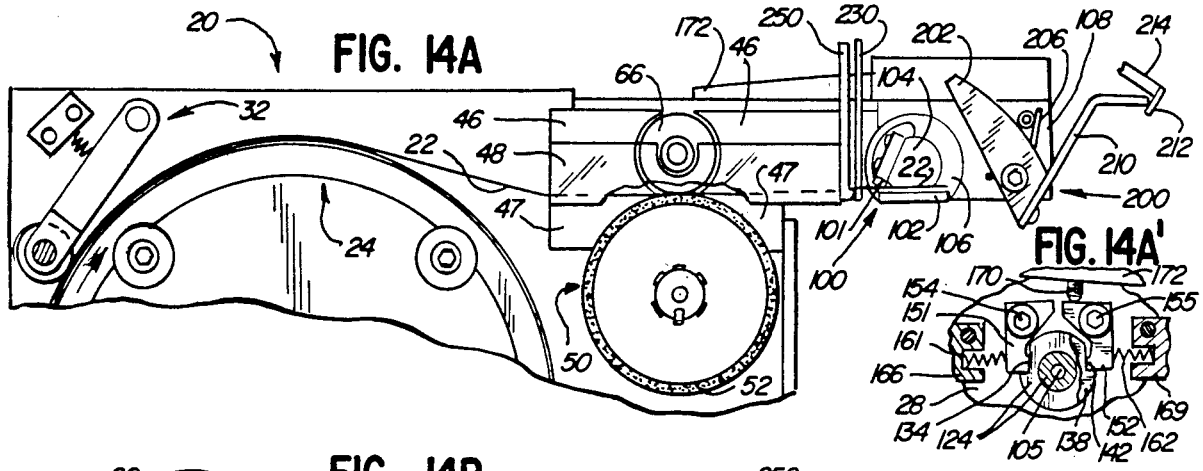
FIG. 14A
FIG. 14A'
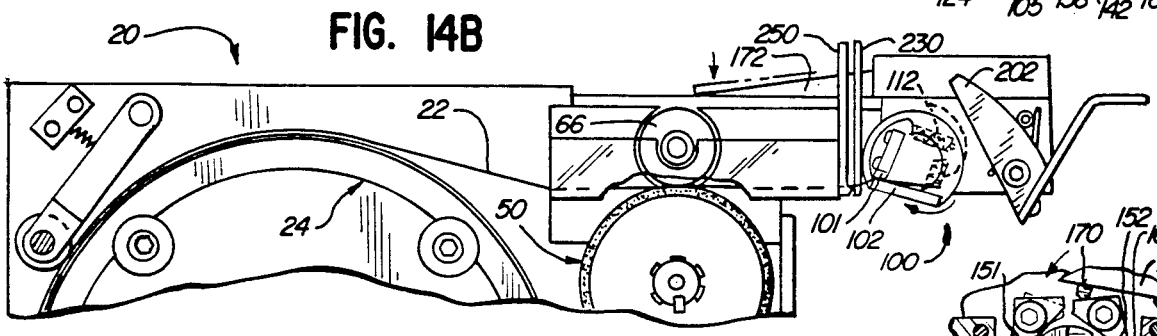
FIG. 14B
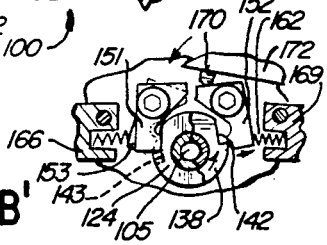
FIG. 14B'
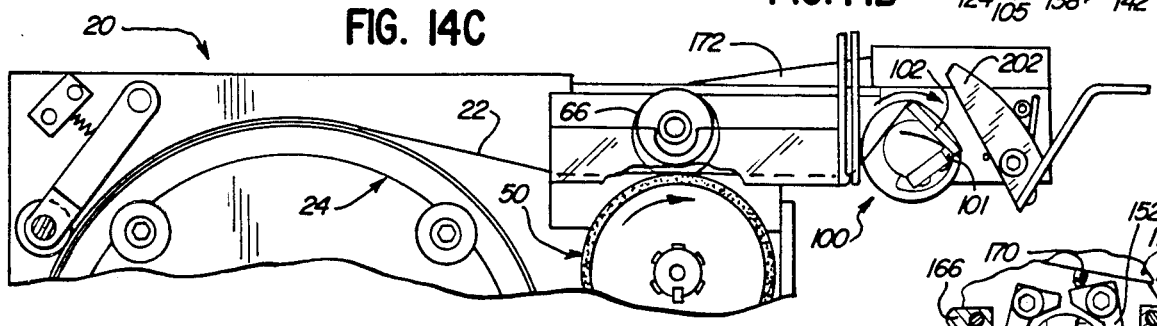
FIG. 14C
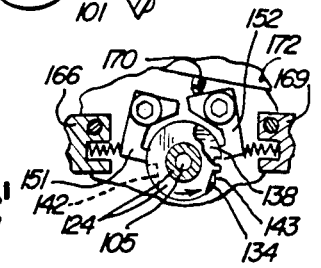
FIG. 14C'
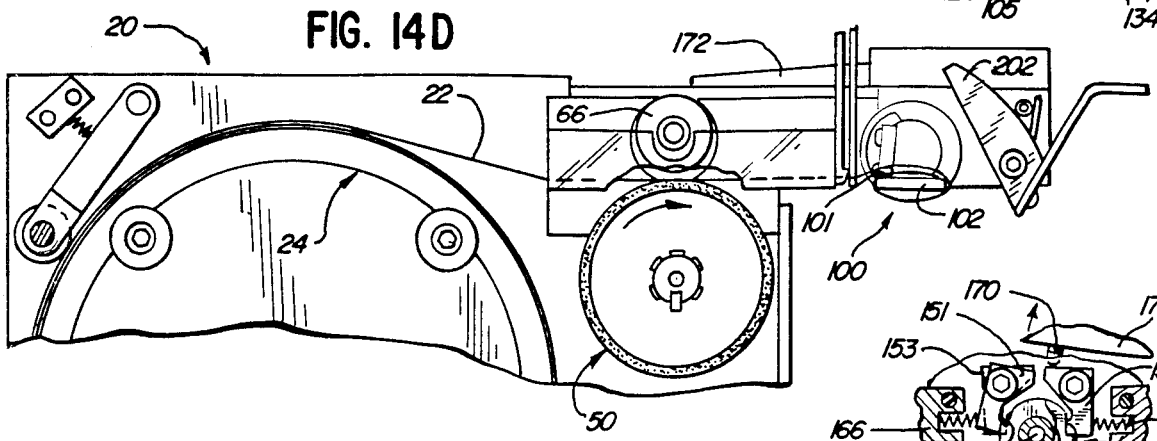
FIG. 14D
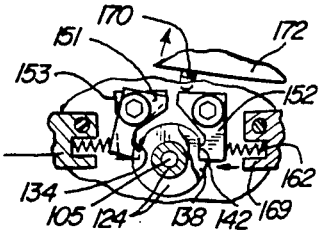
FIG. 14D'

FIG. 14E
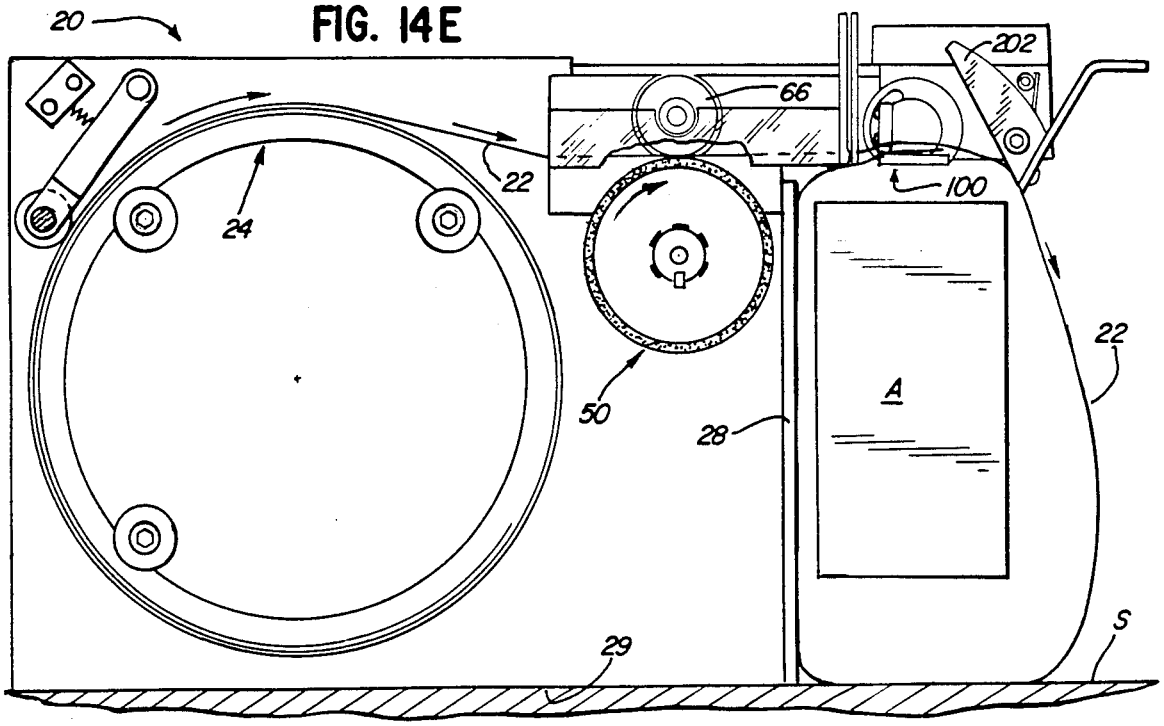
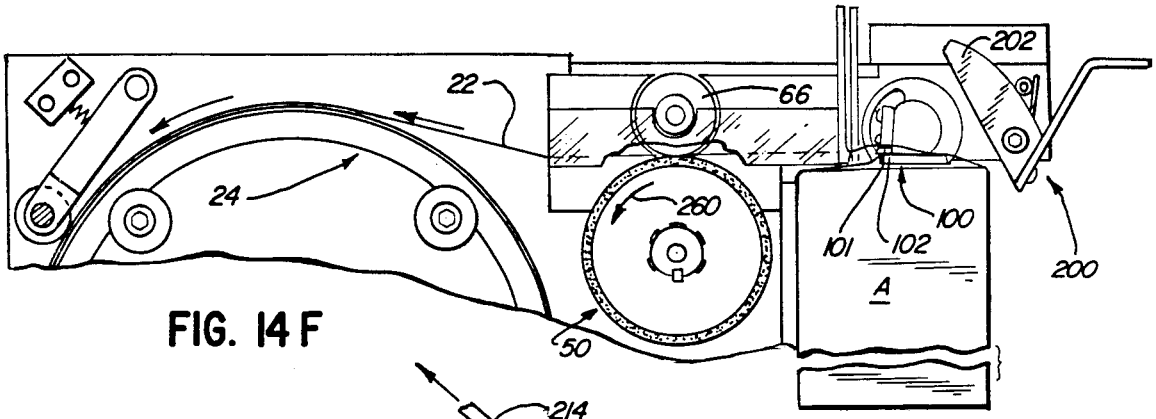
FIG. 14F
FIG. 14G
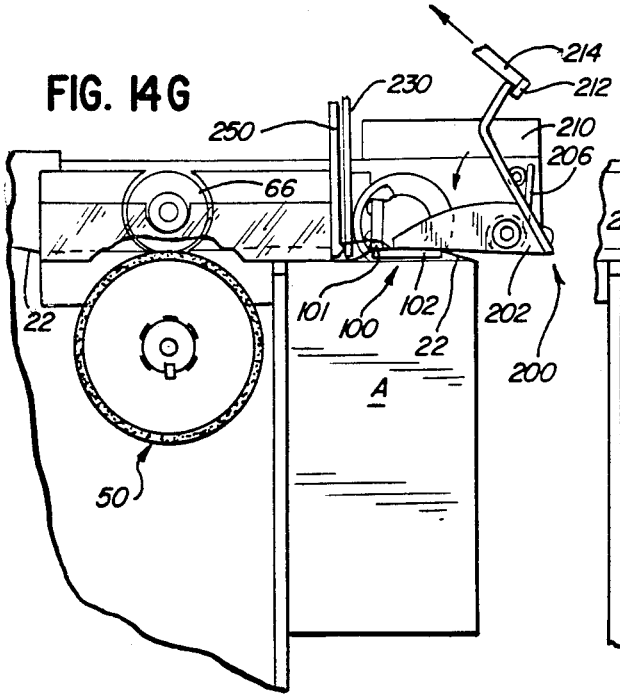
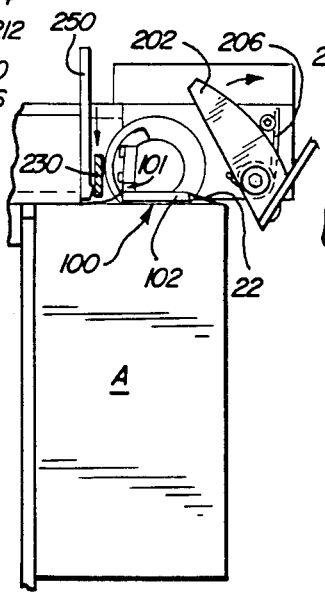
FIG. 14H
FIG. 14I
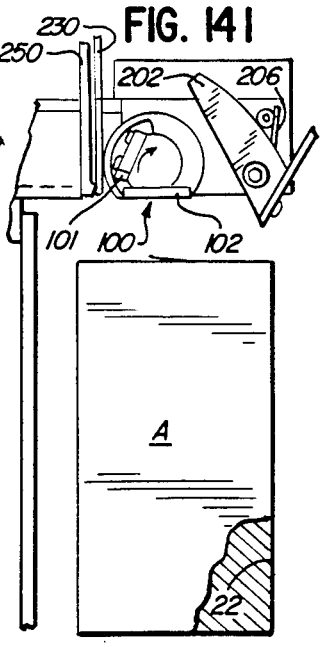

METHOD AND APPARATUS FOR FORMING A LOOP WITH END-GRIPPED STRAP

TECHNICAL FIELD

This invention relates to the formation of a loop of flexible binding or strapping material. Such loop formation may be employed during the process of binding an object, such as a package or one or more articles.

BACKGROUND OF THE INVENTION AND TECHNICAL PROBLEMS POSED BY THE PRIOR ART

Disclosures have been made of methods and apparatus for forming a strap loop which may ultimately be used to bind a package or other object. For example, see U.S. Pat. Nos. Re. 31,353, 4,077,313, 4,079,667, and 4,378,262. While the methods and apparatus disclosed in these patents function well with respect to the applications for which they are intended, it would be desirable to provide an improved method and apparatus for accommodating a variety of types of strap.

In particular, it would be advantageous to provide an improved method and apparatus that is particularly suitable for very thin strap such as "film" strap. It would also be beneficial if such an improved apparatus could be embodied in a relatively small, portable unit.

SUMMARY OF THE INVENTION

A method is provided for forming a loop of strap for encompassing an article. A length of strap is fed to orient a segment between two spaced-apart gripping members. The strap segment is gripped with the gripping members by effecting relative movement between the gripping members to clamp the strap segments between the gripping members. While continuing to grip the strap segment, the gripping members are moved together in a closed path to form a primary loop in the strap around at least one of the gripping members. Next, while still continuing to grip the strap segment, the strap is fed to expand the primary loop to an expanded loop having a larger size for accommodating the article.

In the disclosed apparatus, the two gripping members are mounted on the frame for movement together in the closed path. Means are provided for effecting the relative movement between the gripping members to cause the strap segment to be clamped. Means are also provided on the frame for moving the two gripping members together in the closed path. A strap drive means is provided for feeding the strap to expand the loop.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 5 is a greatly enlarged, fragmentary, cross-sectional view of the traction wheel and back-up wheel assembly taken generally along plane 5—5 in FIG. 2;

FIG. 6 is a fragmentary, cross-sectional view taken generally along the plane 6—6 in FIG. 5;

FIG. 7 is a view similar to FIG. 5, but showing the back-up wheel in a moved position disengaged from the traction wheel;

FIG. 8 is a fragmentary, cross-sectional view taken generally along the plane 8—8 in FIG. 7;

FIGS. 14A, 14B, 14C, 14D, 14E, 14F, 14G, 14H, and 14I are simplified, fragmentary, front elevation views illustrating the operational sequence of the illustrated preferred embodiment of the apparatus of the present invention according to one form of the method of the present invention; and FIGS. 14A', 14B', 14C', and 14D' are rear elevation views of the gripping member assembly of the apparatus shown in an operating sequence corresponding with the sequence of operation illustrated in FIGS. 14A, 14B, 14C, and 14D, respectively.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiments so described, and the scope of the invention will be pointed out in the appended claims.

The Apparatus

For ease of description, the disclosed novel apparatus is described in the normal (upright) operating position, and terms such as upper, lower, horizontal, etc., are used with reference to this position. It will be understood, however, that the novel apparatus may be manufactured, stored, transported, used, and sold in an orientation other than the exact orientation described.

The apparatus of this invention is used with, or includes, certain conventional components and control mechanisms, the details of which, although not fully illustrated or described, will be apparent to those having skill in the art and an understanding of the necessary functions of such components and control mechanisms.

Some of the figures illustrating the apparatus show conventional structural details and mechanical elements that will be recognized by one skilled in the art. However, the detailed descriptions of such conventional elements are not necessary to an understanding of the invention, and accordingly, are not herein presented.

Figure 1:
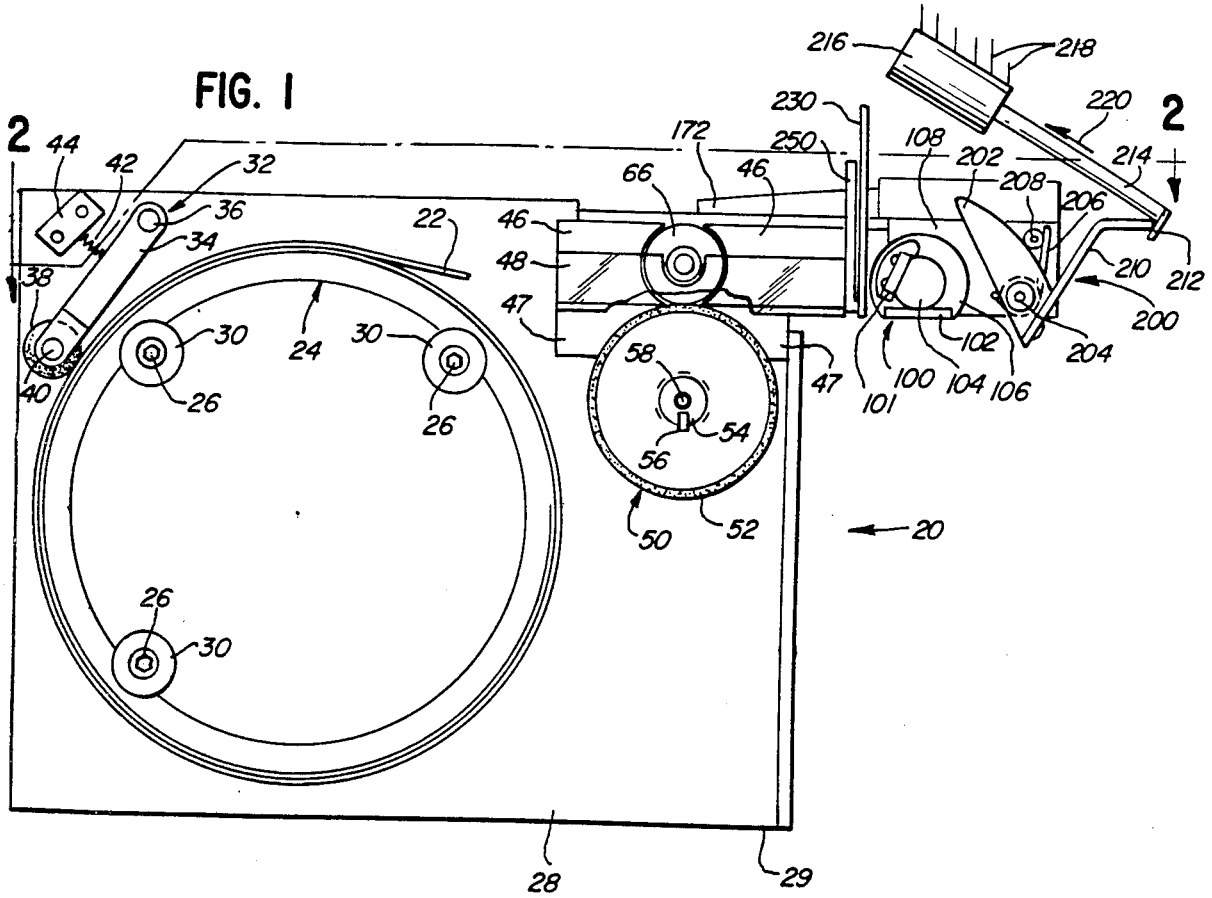
FIG. 1 is a simplified, fragmentary, front elevation view of the apparatus of the present invention with some portions of the strap and apparatus broken away to better illustrate underlying detail.

Referring now to FIG. 1, the novel strap loop-forming apparatus of the present invention is designated generally by reference numeral 20. The apparatus 20 includes a frame 28 defining a generally planar base contact surface 29 for being placed on a suitable support surface S (FIG. 14E), such as a table top.

Although the apparatus 20 may be used to form a loop in a variety of binding or strapping materials, it is especially suitable for forming a loop from non-metallic, thin film strap, such as strap having a thickness of less than about 0.13 mm. (0.005 in.). Such strap is designated generally in the figures by reference numeral 22. Such strap 22 may be fabricated from polypropylene, polyester, nylon, or other suitable materials.

A presently preferred form of such strap 22 is polypropylene strap having a thickness of 0.08 mm. (0.003 in.) and a width of 19.05 mm. (0.75 in.). Such film is extremely flexible. It cannot be easily pushed through a conventional strap chute. It does not, by itself, maintain an open, circular loop of significant size when the loop hangs downwardly under the influence of gravity. Novel methods and means are required for forming a useful loop of such strap for conventional low tension binding applications.

With continued reference to FIG. 1, it is seen that the strap 22 is preferably provided on a strap reel 24 which may be mounted on suitable support studs 26 projecting from the front of the apparatus frame 28. Suitable retaining members, such as washers 30, are disposed on each stud 26 for retaining the reel 24 in proper position. The studs 26 and the washers 30 may be removed when desired to accommodate removal of the strap reel 24 and replacement with a new reel.

Figure 2:
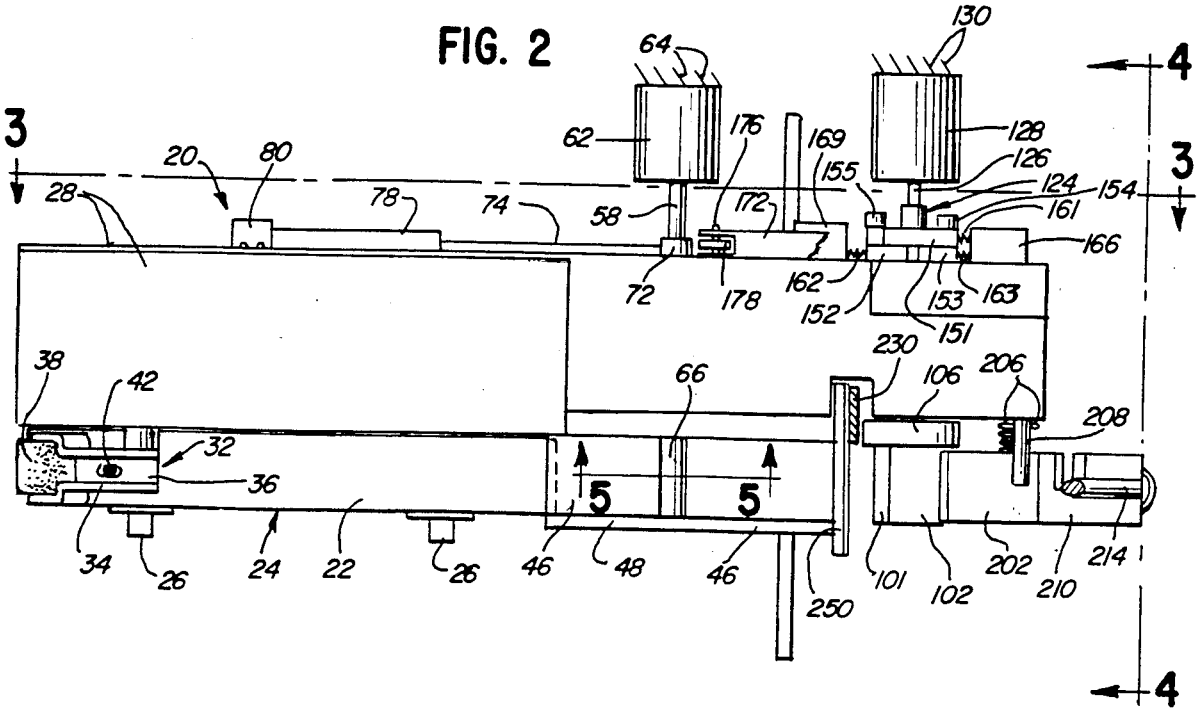
FIG. 2 is a fragmentary, plan view taken in partial cross-section generally along the plane 2—2 in FIG. 1.

In the simplest form contemplated by the present invention, the strap reel 24 may be freely rotatable on the studs 26 about the central axis of the reel 24. However, if desired, conventional or special snubbing and/or retracting mechanisms may be incorporated. For example, a friction snubbing device 32 may be provided as illustrated in FIGS. 1 and 2. The device 32 includes an arm 34 pivotally mounted about a pin 36 to the frame 28. The distal end of the arm 34 carries a roller 38 rotatably mounted about a pin 40 that is disposed on the arm 34. The arm 34 is biased against the outer layer of strap 22 on the reel 24 by a spring 42 which is carried on a mounting block 44 on the frame 28.

When the strap 22 is withdrawn (pulled forwardly) off the reel (clockwise as viewed in FIG. 1) by means described in detail hereinafter, the roller 38 acts as a snubber or friction brake to prevent over-rotation of the reel 24 when the pulling force on the strap 22 is terminated.

Additionally, or alternatively, the reel 24 could include a conventional or special strap retracting means (not illustrated). Such a retracting means would function in the well-known amd conventional manner to apply counter-torque or retracting torque to the reel 24 so as to oppose the strap withdrawing torque. The retracting torque would be relatively low and could be easily overcome by the strap withdrawing torque. However, when the strap withdrawing torque falls below a predetermined magnitude, the retracting means would cause the reel 24 to rotate (in the counterclockwise direction as viewed in FIG. 1) to rewind the strap 22. The detailed design and specific structure of such a conventional or special retracting means form no part of the present invention.

As best illustrated in FIGS. 1 and 5–8, the apparatus 20 includes a traction wheel 50. Preferably the traction wheel 50 has a molded polyurethane periphery 52 which may be grooved. In some applications, an O-ring of conventional manufacture may be employed in place of the molded polyurethane periphery. Other compositions and structures may be provided for the traction wheel 50, depending upon, inter alia, the type of strap, the strap width and thickness, the surface speed of the wheel, and the operating force of the strap 22 against the wheel.

The traction wheel 50 is mounted on a hub 54 by means of a key 56, and the hub 54 is mounted on a shaft 58 which is journaled for rotation in a mounting block 60 (FIGS. 6 and 7). A motor 62 (FIGS. 2 and 4) is operably connected with the shaft 58 for rotating the traction wheel 50 in either direction. The motor 62 is appropriately mounted to a suitable frame portion which is only diagrammatically illustrated in FIGS. 2 and 4 by the slanted lines 64.

A back-up wheel 66 is mounted above the traction wheel 50 for rotation on a shaft 68 which is eccentrically mounted to the end of an enlarged cylindrical portion 70 of a shaft 72. As best illustrated in FIG. 3, the shaft 72 is journaled in the mounting block 60 and is connected on its distal end at the rear of the apparatus 20 to a rod 74 which is in turn connected to an actuator rod 76 of an electric solenoid actuator 78 which is mounted with a bracket 80 to a portion of the frame 28.

With reference to FIGS. 5 and 6, it can be seen that the axis 82 of the back-up wheel shaft 68 is laterally offset with respect to the axis 84 of the enlarged end portion 70 of the shaft 72. The back-up wheel 66 is thus eccentrically movable between a first position (illustrated in FIGS. 5 and 6) wherein the back-up wheel 66 engages the traction wheel 50 and a second position (illustrated in FIGS. 7 and 8) wherein the back-up wheel 66 is spaced away from the traction wheel 50.

Figure 3:
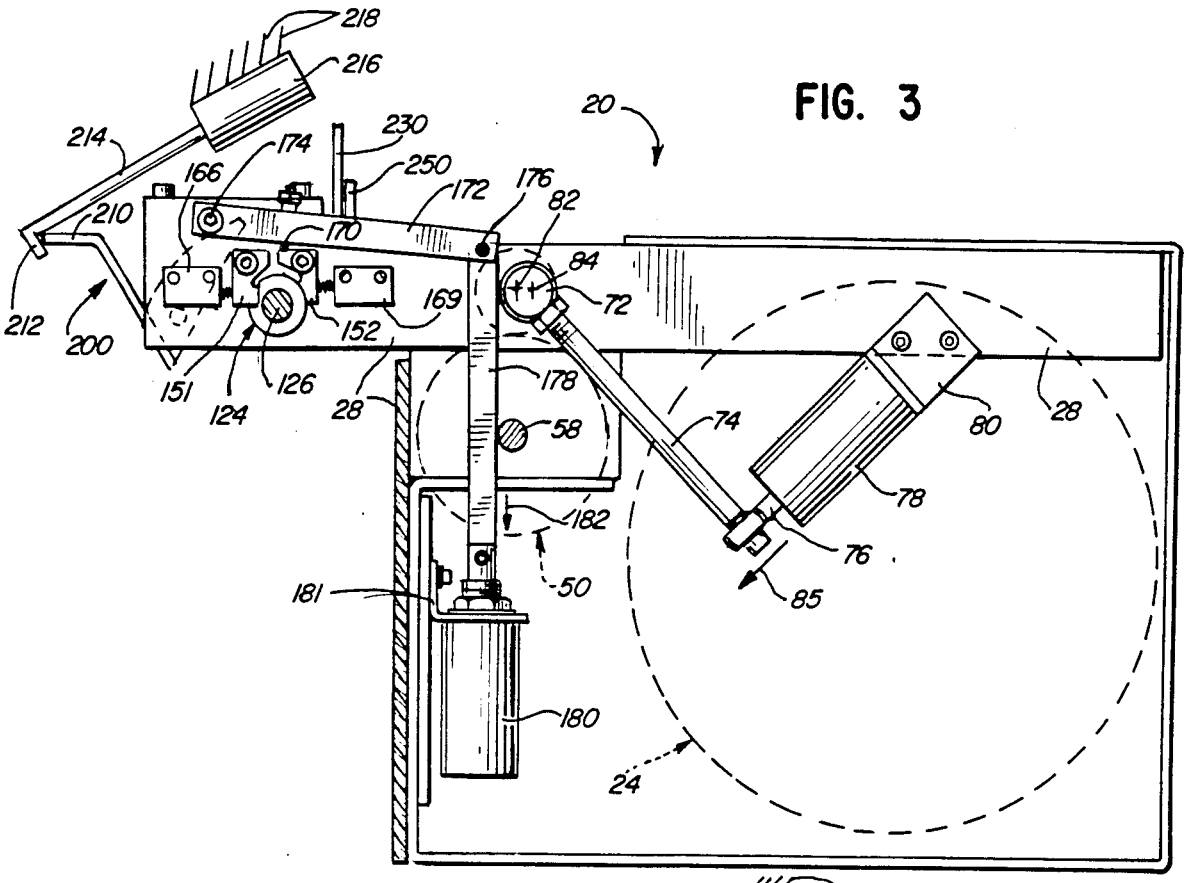
FIG. 3 is a simplified, cross-sectional view of the apparatus taken generally along the plane 3—3 in FIG. 2.

The movement of the back-up wheel 66 is effected by actuation of the solenoid actuator 78 (FIGS. 2 and 3). The actuator 78 may have an internal spring (not illustrated) for normally maintaining the actuator rod 76 in the fully retracted position so as to normally bias the back-up wheel 66 against the traction wheel 50. Energization of the actuator 78 extends the rod 76 (in the direction of arrow 85 in FIG. 3) to raise the back-up wheel 66 away from the traction wheel 50.

When the back-up wheel 66 is moved toward engagement with the traction wheel 50 as illustrated in FIG. 5, the strap (not illustrated in FIGS. 5–8) would be urged by the back-up wheel 66 against the traction wheel 50 (with a small force). On the other hand, when the back-up wheel 66 is moved away from the traction wheel 50 (as illustrated in FIGS. 7 and 8), the strap would not be sufficiently frictionally engaged with the surface of the traction wheel 50 to effect movement of the strap when the traction wheel is rotating.

Since the traction wheel 50 may be operated in either direction of rotation, the traction wheel 50 can function as a feeding means for feeding the strap forwardly (to the right as viewed in FIG. 1) and subsequently as a strap retracting or tensioning means for retracting the strap rearwardly (to the left as viewed in FIG. 1). The traction wheel motor 62 may be a conventional electric motor and may be controlled through a conventional control system for rotation as necessary in either direction. However, it is to be realized that the traction wheel 50 need not be rotated by a separate, dedicated motor, such as motor 62. If desired, the traction wheel 50 could be rotated through a suitable drive system from a prime mover (not illustrated) that could also function to operate other subassemblies in the apparatus 20 (either simultaneously and/or sequentially).

As illustrated generally in FIGS. 1 and 14A, the strap 22 is withdrawn from the strap reel 24 and extends over the traction wheel 50 to a gripping member assembly 100. As best illustrated in FIGS. 5 and 6, a channel 45 is provided for receiving the strap 22 adjacent the traction wheel 50, and the channel 45 is defined on the top by guide blocks 46 and on the bottom by guide blocks 47. The strap 22 is guided on its inner lateral edge on the inside of the apparatus 20 by the block 60 (FIGS. 6 and 7). The outer lateral edge of the strap 22 is guided on the outside of the apparatus 20 by a transparent plate 48 (visible in FIG. 1, but omitted from FIGS. 5–8).

The gripping member assembly 100 is provided for gripping a segment of the strap 22 and moving the strap segment in a closed path to form a primary loop which is subsequently expanded to a larger size. The gripping assembly 100 is illustrated in detail in the exploded perspective view of FIG. 13 and in the cross-sectional views of FIGS. of 9–12.

Figure 4:
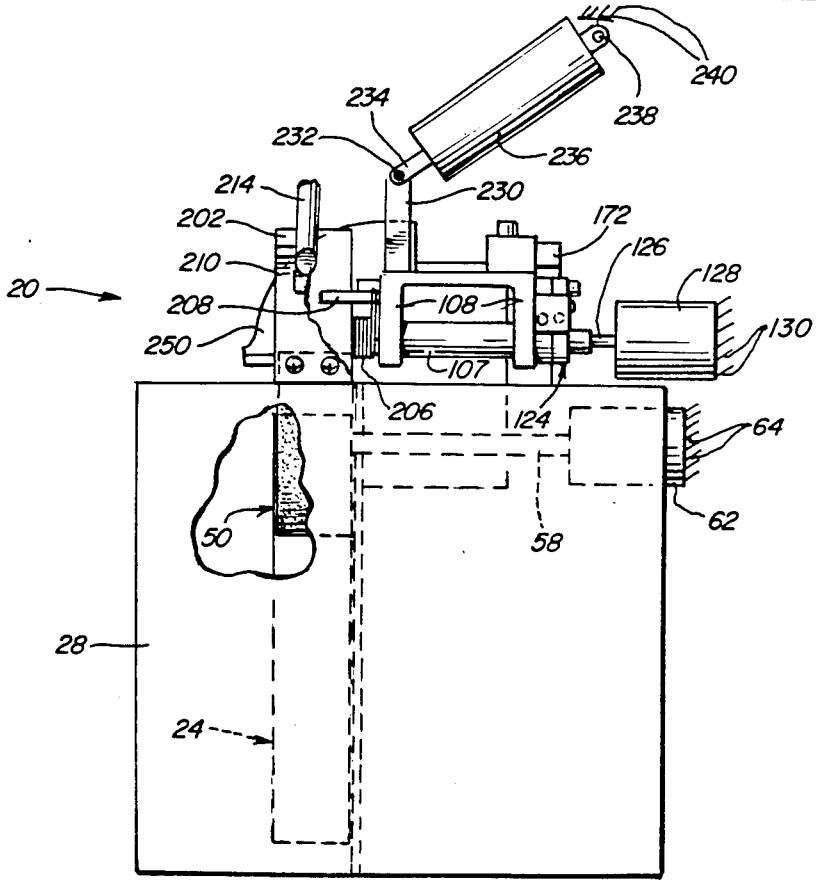
FIG. 4 is a simplified, fragmentary, end view taken generally along the plane 4—4 in FIG. 2.
Figures 9, 10, 11, 12, 13:
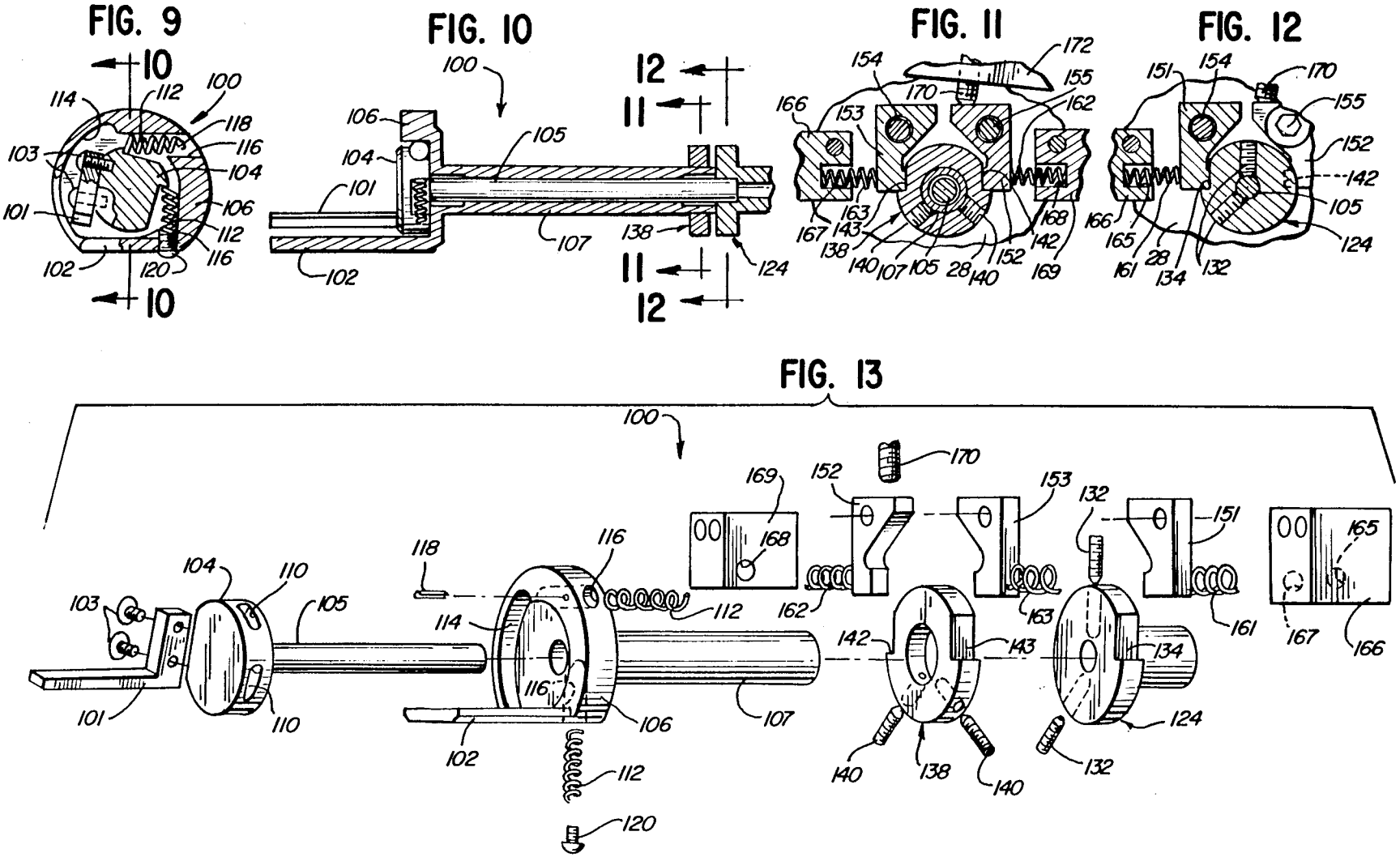
FIG. 9 is a greatly enlarged, partial, cross-sectional view of the gripping member assembly.
FIG. 10 is a fragmentary, cross-sectional view taken generally along the plane 10—10 in FIG. 9.
FIG. 11 is a greatly enlarged, fragmentary, partial cross-sectional view taken along the plane 11—11 in FIG. 10.
FIG. 12 is agreatly enlarged, fragmentary, partial cross-sectional view taken generally along the plane 12—12 in FIG. 10.
FIG. 13 is an enlarged, fragmentary, exploded, perspective view of the gripping member assembly illustrated in FIGS. 9-12.

With reference to FIGS. 10 and 13, it is seen that two gripping members are provided, a gripper arm 101 and an anvil 102. The gripper arm 101 is mounted with screws 103 to a generally cylindrical portion 104 on a first shaft 105 that is mounted for rotation relative to the apparatus frame. The anvil 102 extends from a generally cylindrical portion 106 that is disposed at the end of a hollow, second shaft 107. The hollow, second shaft 107 is mounted concentrically on the first shaft 105 for rotation relative to the first shaft 105. As best illustrated in FIG. 4, the exterior of the second shaft 107 is journaled for rotation in depending flanges 108 of a portion of the frame 28.

With reference to FIGS. 9 and 13, it is seen that the generally cylindrical portion 104 on the end of the first shaft 105 defines two recesses 110, and each recess 110 receives an end of a compression spring 112. The cylindrical portion 104, along with the springs 112, is received within a cavity 114 of the generally cylindrical portion 106 on the end of the second shaft 107. The outer end of each spring 112 is received within a bore 116 of the generally cylindrical portion 106. The upper spring 112 is retained in position in the generally cylindrical portion 106 by a roll pin 118, and the lower spring 112 is retained in position in the generally cylindrical portion 106 by a screw 120 engaged with the portion 106.

With reference to FIGS. 9, 10, and 13, it can be seen that if the inner shaft 105 is prevented from rotating, the springs 112 would function to rotate the generally cylindrical portion 106 (clockwise as viewed in FIG. 9) so as to move the anvil 102 toward the gripper arm 101. A mechanism for permitting such action is next described.

The rearward end of the second, hollow shaft 107 is shorter than the first shaft 105, and the first shaft 105 extends rearwardly beyond the second shaft 107. A first annular member 124 (FIGS. 10–13) is mounted on the end of the first shaft 105 and is secured to a shaft 126 (FIGS. 2 and 4) of a suitable rotating drive means which may be in the form of a motor 128. The motor 128 is mounted to a suitable portion of the frame 28, and such a suitable mounting portion is only diagrammatically illustrated by slanted lines 130 in FIGS. 2 and 4.

Although not illustrated, it may be preferable to eliminate the motor 128 and rotate the gripping member shaft 126 through appropriate conventional gear, chain, or belt drive elements from the traction wheel motor 62. Alternatively, the shaft 126 may be rotated directly by a separate electric solenoid operator or by other suitable means.

The first generally annular member 124 is secured with suitable set screws 132 to the first shaft 105. The first annular member 124 includes a cylindrical surface defining first detent element with a notch 134, the purpose of which will be described in detail hereinafter.

A second generally annular member 138 is mounted with set screws 140 to the hollow, second shaft 107. The second annular member 138 includes a cylindrical surface that defines a second detent element with a notch 142 and a third detent element with a notch 143.

As best illustrated in FIGS. 11–13, the apparatus 20 also includes a first pawl 151, a second pawl 152, and a third pawl 153. Each pawl is pivotally mounted to the frame 28. With reference to FIGS. 11 and 12, the first pawl 151 and the third pawl 153 are seen to be pivotally mounted about a common pin 154. The second pawl 152 is pivotally mounted about a pin 155.

The apparatus 20 also includes a first biasing means or spring 161, a second biasing means or spring 162, and a third biasing means or spring 163 to effect engagement of the first pawl 151, the second pawl 152, and the third pawl 153, respectively, with the first detent element notch 134, the second detent element notch 142, and the third detent element notch 143, respectively. The first spring 161 is received in a first bore 165 in a block 166 mounted to the frame 28. The third spring 163 is similarly received in an adjacent bore 167 in the block 166. The spring 162 is received in a bore 168 in a block 169 which is also mounted to the frame 28.

With reference to FIGS. 11 and 13, it can be seen that a member 170 is provided for pivoting the second pawl 152 out of the detent element notch 142 against the compression spring 162 and toward the block 169. The member 170 is carried on an arm 172 (FIGS. 11 and 3) which is pivotally mounted on a pin 174 (FIG. 3) to the frame 28. The other end of the arm 172 is pivotally connected by a pin 176 to an actuator arm 178 of an electric solenoid actuator 180. The actuator 180 is mounted with a bracket 181 to the frame 28. Energization of the solenoid actuator 180 causes the arm 178 to move downwardly (in the direction of arrow 182 in FIG. 3) to effect the pivoting action of the second pawl 152 out of engagement with the second detent element notch 142. Of course, the actuator 180 may be replaced by other suitable conventional or special means (not illustrated) for effecting the pivoting action of the second pawl 152.

A joint forming assembly 200 (FIGS. 1 and 3) is provided for cooperating with the anvil 102 to form a joint in overlapping portions of the strap after the strap loop is formed in a manner described in detail hereinafter. The joint forming assembly 200 includes suitable strap contacting or joining member 202 (FIG. 1) that is pivotally mounted about a pin 204 on the frame 28. A torsion spring 206 is disposed around the pin 204. One end of the spring 206 engages the bottom of the strap contacting member 202, and the other end of the spring engages a fixed pin 208. The spring 206 acts to bias the strap contacting member 202 upwardly away from the anvil 102.

An actuating arm 210 is mounted to one end of the strap contacting member 202 and is adapted to be engaged by a foot 212 carried at the end of an actuator rod 214 of an electric solenoid actuator 216. The electric solenoid actuator 216 is mounted to a suitable portion of the frame which is only diagrammatically illustrated in FIGS. 1 and 3 by the slanted lines 218.

With reference to FIG. 1, it can be seen that actuation of the electric solenoid actuator 216 to retract the rod 214 in the direction of arrow 220 will cause the strap contacting member 202 to pivot downwardly toward the anvil 102.

The strap contacting member 202 may employ any suitable means for joining overlapping strap portions after the strap loop is formed by means described in detail hereinafter. For example, the strap contacting member 202 may include a vibrating mechanism for effecting a friction-fusion weld joint of the overlapping strap portions. Alternatively, the strap contacting member 202 may contain a suitable conventional ultrasonic welding mechanism or a suitable heating mechanism for producing a joint. The formation of the joint per se, and the mechanism for forming the joint, form no part of the broadest aspects of the present invention.

Means may be provided, if desired, for automatically severing the trailing portion of the strap 22 from the strap loop. In the preferred embodiment of the apparatus illustrated, an automatically actuated knife mechanism is provided for this purpose. Specifically, as best illustrated in FIGS. 1 and 4, a knife blade 230 is provided for being maintained in a normally unactuated, vertical orientation between the strap gripping member assembly 100 and the traction wheel 50.

The blade 230 is pivotally connected to the apparatus frame near the bottom of the blade 230 about a suitable pivot pin (not visible in the figures). The blade 230 is also pivotably connected at the top, by means of a pin 232, to the end of an actuating rod 234 of an electric solenoid actuator 236. As illustrated in FIG. 4, the actuator 236 is pivotally mounted at its distal end by means of a pin 238 to a suitable portion of the apparatus frame which is diagrammatically illustrated in FIG. 4 by the slanted lines 240.

Actuation of the actuator 236 to extend the actuator rod 234 causes the knife blade 230 to pivot downwardly to a substantially horizontal position (illustrated in cross-section in FIG. 14H). In the lowered position, the leading edge of the blade 230 is sufficiently below the path of travel of the trailing portion of the strap 22 so as to effect a severing of the strap. Preferably, a blade guard plate 250 (FIGS. 1 and 4) is provided on one side of the knife blade 230 and functions to block access to the knife blade, movement path.

Operation Of The Apparatus According To The Method Of The Invention

The sequence of operation of the apparatus 20 is next described. While the apparatus 20 functions to form a primary strap loop and then expand the primary loop to a larger size in accordance with the teachings of the invention, the apparatus 20 preferably also functions to effect a complete strapping cycle wherein an article is bound with a tensioned loop of strap. This involves feeding a length of the strap from which the loop can be formed, effecting formation of the loop in a convenient orientation for accommodating the article within the loop, tensioning the loop tight about the article, joining the overlapping strap portions of the tensioned loop, and severing (before or after joint formation) the trailing portion of the strap from the tensioned loop.

A typical operating cycle of the apparatus 20 is sequentially illustrated in FIGS. 14A–14I. The apparatus 20 is ready to start a new strapping cycle when the apparatus mechanisms are in an initial or "start" position or condition as generally illustrated in FIG. 14A. FIG. 14A corresponds to FIG. 1, but in FIG. 14A the strap 22 is shown threaded between the traction wheel 50 and back-up wheel 66 and as having the leading end of the strap positioned on top of the anvil 102 below the gripper arm 101.

FIG. 14A' illustrates the initial positions of the annular members 124 and 138 and of the pawls 151, 152, and 153, which initial positions are identical to those positions illustrated in FIGS. 11 and 12 as described above in detail. In these initial positions, pawls 152 and 153 prevent rotation of the anvil 102 in either direction, and pawl 151 prevents rotation of the gripper arm 101 toward the anvil 102 (counterclockwise as viewed in FIGS. 9 and 14A).

The new strapping cycle is initiated by actuation of a suitable control system (not illustrated). First, the electric solenoid actuator 180 (FIG. 3) is energized to pivot link member 172 downwardly. This causes the member 170, carried by the link member 172, to pivot the second pawl 152 out of engagement with the second detent element notch 142 as illustrated in FIG. 14B.

With the annular member 138 now unlatched, the springs 112, which act between the gripper arm first shaft 105 and the anvil second shaft 107 (FIGS. 9, 10, and 13), urge the second shaft 107 to rotate (counterclockwise as viewed in FIG. 14B). The anvil 102, mounted on shaft 107, rotates toward the gripper arm 101 to clamp the segment of strap 22. (The pawl 151 (FIG. 14B') remains engaged with the annular member 124 and thereby prevents rotation of the first shaft 105 and gripper arm 101 relative to the second shaft 107 and anvil 102.) When the anvil 102 is in the "clamping" position (FIG. 14B), the annular member 138 is in a moved, or incrementally rotated, position that is out of registry with the annular member 124. That is, annular member 138 has been rotated to move the notches 142 and 143 so that notch 143 is no longer in registry with the notch 134 of the adjacent annular member 124 (FIG. 14B').

After the anvil 102 and the connected annular member 138 rotate to the "clamping" position as illustrated in FIGS. 14B and 14B', the electric solenoid actuator 180 (FIG. 3) is deenergized. However, the pawl 152 remains cammed outwardly by the cylindrical surface of the annular member 138.

Next, the motor 128 (FIGS. 2 and 4) is energized in response to the control system to effect rotation of the gripper arm first shaft 105 in the counterclockwise direction as viewed in FIGS. 14B' and 14C'. This rotation corresponds to the clockwise direction of rotation of the gripper arm 101 when viewing the apparatus 20 from the front as illustrated in FIGs 14B and 14C.

Since the anvil 102 is biased by the springs 112 to clamp the strap 22 against the gripper arm 101, the second shaft 107 and anvil 102 extending therefrom rotate in the clamping relationship with the gripper arm 101. The annular members 124 and 138, along with their connected shafts 105 and 107, respectively, rotate together (but out of registry owing to the initial incremental rotation of the annular member 138 that occurred when the anvil 102 initially clamped the strap 22 against the gripper arm 101).

FIGS. 14C and 14C' show the anvil 102 and arm 101 rotated a little more than 180° from the initial position illustrated in FIGS. 14A and 14A', and FIG. 14C' shows how the pawls 152 and 153 are cammed outwardly by the cylindrical surface of the annular member 138 and how the pawl 151 is cammed outwardly by the cylindrical surface of the annular member 124.

As best illustrated in FIGS. 14C and 14D, rotation of the gripper member assembly 100 causes the strap 22 to form a loop about the anvil 102. During rotation of the gripper member assembly 100, the strap 22 is pulled off of the strap reel 24. The traction wheel 50 need not be rotated by motor 62 as the strap 22 is pulled off of the strap reel 24 by the rotating gripper member assembly 100 if the back-up wheel 66 is elevated to accommodate the pulling of the strap 22 over the top of the traction wheel 50. However, the traction wheel 50 is preferably also simultaneously rotated to feed the strap forward. To this end, the back-up wheel 66 is maintained in the lowered position, and the traction wheel motor 62 is energized substantially simultaneously with the energization of the gripper assembly motor 128.

Further, the traction wheel motor 62 is preferably operated to rotate the traction wheel 50 at a speed sufficient to feed the strap 22 at a rate greater than that required to accommodate the rotation of the gripper assembly 100. Specifically, it is desired to provide enough strap around the anvil 102 so that the initial, primary loop formed about the anvil 102 is somewhat larger than the anvil 102. This prevents the strap 22 from being tightly wrapped around the anvil 102. Tightly wrapping the loop of strap 22 around the anvil 102 could, with some types of straps (e.g., thin film strap), cause excessive forces to be imposed on the strap and/or cause the strap to crease.

After the gripper member assembly 100 has been rotated to the position illustrated in FIG. 14D, the annular member 138 is again in its initial orientation wherein the detent notch 142 is aligned to receive the pawl 152 which is biased into engagement with the notch 142 by the spring 162. Since the electric solenoid actuator 180 (FIG. 3) has been previously deenergized, the member 170 and link arm 172 connected to the actuator 180 afford no substantial resistance to the return of the pawl 152 to its original latching position as illustrated in FIG.. 14D'.

At this point, the gripper assembly motor 128 is deenergized and its rotation terminated by a suitable electric brake (not illustrated) or other suitable means. Although the third pawl 153 is also biased back into engagement with the notch 143 on the annular member 138 (FIG.. 11) by the spring 163, the first pawl 151 remains cammed outwardly against the outer cylindrical surface of the annular member 124. The annular member 124 is still maintained out of registry relative to the annular member 138 by means of the clamping springs 112 (FIGS. 13 and 14B).

Although the rotation of the gripper assembly motor 128 is terminated at this point, the traction motor 62 continues to rotate the traction wheel 50 to feed the strap 22 forward so as to expand the primary loop to an expanded loop having a larger size for accommodating an article A as illustrated in FIG. 14E. Preferably, as best illustrated in FIG. 14E, the apparatus 20 has been positioned with the generally planar base contact surface 29 on a support surface S (such as the top of a table or the like). The gripper member assembly 100 is thus cantilevered over the support surface S, and the expanding loop of strap 22 is free to grow downwardly.

If desired, the gripper member assembly 100 could be located near the bottom of the apparatus 20 in a non-cantilevered orientation with the "at rest" initial position of the gripper member assembly 100 being oriented 180 degrees from the position illustrated in FIG.. 1. This would permit the loop of strap 22 to expand upwardly.

In any case, before the article A is placed within the loop, the loop is allowed to grow to the desired size. Typically, in the illustrated embodiment of the apparatus 20, the bottom of the loop would contact the support surface S, and this would cause the sides of the strap loop to bow outwardly. One side of the strap loop would eventually come to rest against the vertical side of the apparatus frame 28, and the other side of the strap loop, being unrestrained, would bow outwardly a greater amount. This results in the formation of a strap loop having a somewhat rectangular configuration which more easily accommodates an article A having a typical rectangular shape.

After the article A has been positioned within the expanded loop of strap 22, the strap loop is tensioned about the article as best illustrated in FIG. 14F. To this end, an appropriate control system is provided for terminating the feeding of the strap 22 and for initiating retraction of the strap 22. This may be effected by means of conventional timer systems or traction wheel rotation counting systems well-known to those skilled in the art.

In any event, when the desired amount of strap 22 has been fed to expand the loop to the desired size, the traction wheel motor rotation is reversed so as to reverse the direction of rotation f the traction wheel 50 (in the direction of arrow 260 illustrated in FIG. 14F). The strap 22 is thus drawn tight about the article A. As the strap 22 is retracted, appropriate mechanisms associated with the strap wheel 24 may effect rotation of the strap reel 24 to take up the retracting strap. Such mechanisms, previously discussed above, may include conventional torque devices for effecting the take-up rotation of the reel 24 whenever the withdrawing tension on the strap 22 is less than some predetermined value.

In any event, when the strap 22 has been drawn tight around the article A, the rotation of the traction wheel 50 in the tensioning direction (counterclockwise as in FIG. 14F) is terminated by any suitable conventional or special means. One suitable conventional means could include a strap tension sensing system of conventional design (not illustrated). Alternatively, the traction wheel motor 62 could be designed in the well-known manner to stall at the desired tension level.

The strap tension is maintained by preventing rotation of the traction wheel 50 back in the clockwise direction (as viewed in FIG. 14F). To this end, the traction wheel motor 62 may be maintained in the stall condition or the motor 62 may be deenergized and an electric or mechanical brake may be applied.

In any event, with tension maintained on the strap loop about the article A, the overlapping strap ends on top of the anvil 102 are joined by any suitable conventional or special process. To this end, the strap joining member 202 is lowered against the overlapping strap segments to press the strap segments together on top of the anvil 102. This is effected by actuating the electric solenoid actuator 216 (FIGS. 1 and 3) to cause the strap joining member 202 to pivot downwardly as best illustrated in FIG. 14G.

As discussed above, the strap joining member 202 may include suitable mechanisms for joining the overlapping strap segments, such as ultrasonic mechanisms, friction fusion mechanisms, strap heating mechanisms, and the like. Such mechanisms may be of conventional design or may be of special design. The details of such mechanisms form no part of the present invention.

When the strap joining member 202 is lowered against the overlapping strap segments, sufficient force is preferably exerted on the overlapping strap segments against the anvil 102 so as to withstand the loop tension force. The tension on the trailing portion of the strap may then be released, if desired. Typically, for light load binding applications, the force between the anvil 102 and the strap joining member 202 would be about five pounds.

After the overlapping strap segments have been appropriately joined, the electric solenoid actuator 216 (FIG.S. 1 and 3) is deenergized to permit the spring 206 to return the strap joining member 202 to the elevated position.

Before, during, or after joining the overlapping strap segments, the trailing portion of the strap may be severed from the tensioned loop. If the strap is severed before joining the overlapping strap portions, the severance should be effected only after the strap joining member 202 has been lowered against the overlapping strap portions so as to maintain loop tension when the strap is severed.

To sever the strap, the knife blade 230 is pivoted downwardly to sever the trailing portion of the strap from the strap loop around the article A as illustrated in FIG. 14H. This is effected by energizing the electric solenoid actuator 236 (FIG. 4). The knife blade 230 may be returned to the elevated position by means of suitable biasing means (not illustrated) associated with the knife blade 230 per se or integral with the electric solenoid actuator 236. If desired, the strap may be severed by other suitable means, including a hot wire, saw, and the like.

Preferably, the strap 22 should be severed while the trailing portion is not subject to a retraction force or while the strap is otherwise prevented from being pulled back toward the strap reel 24. It is desired to avoid having to subsequently feed the strap forward again to the severing point. If the retracting force on the trailing portion of the strap 22 is to be released prior to severing, this can be done by locking the strap reel 24 to eliminate the retracting torque and by releasing any brake on the deenergized traction wheel motor 62. On the other hand, if tension is still being maintained by an energized, but "stalled" traction wheel motor 62, then the motor 62 could be deenergized or the back-up wheel 66 could be raised off of the strap 22 and away from the traction wheel 50. The latter alternative operation is effected by actuating the electric solenoid actuator 78 (FIG.S. 2 and 3).

As explained above in detail, energization of the actuator 78 to extend the rod 76 will pivot the connecting rod 74 to raise the back-up wheel 66 to the elevated position illustrated in FIG.S. 7 and 8. Immediately prior to the elevation of the back-up wheel 66, the strap reel 24 is locked by suitable conventional means (not illustrated) against rotation in the retraction direction. With the back-up wheel 66 elevated and no retraction torque being applied by the strap reel 24, the trailing portion of the strap 22 is no longer subjected to a retracting force. Thus, when the knife blade 230 is lowered to sever the strap, the severed trailing portion of the strap will not retract further into the apparatus 20.

After the loop strap segments are joined, and after the trailing portion of strap is severed from the loop, the gripper assembly motor 128 (FIG.S. 2 and 4) is again energized momentarily to rotate the first shaft 105 and gripper arm 102 carried thereon to the "open" position illustrated in FIG. 14I. The control system may initiate this rotation of the motor 128 after a suitable time delay in response to actuation of the knife blade actuator 236 or of strap contacting member actuator 216. In any event, the gripper arm 101 rotates away from the anvil 102 which remains in the substantially horizontal position shown in FIG. 14I owing to the latching of the annular member 138 and connected anvil second shaft 107 by the pawls 152 and 153.

The rotation of the motor 128 is terminated after the gripper arm 101 has reached the open position illustrated in FIG. 14I. In this position, the annular member 124, which is connected to the gripper arm first shaft 105, has rotated to the point where the detent notch 134 in the annular member 124 is again in the "home" position to receive the first pawl 151 in the engaging relationship as illustrated in FIG. 14A'.

The article A can then be removed from the apparatus 20 by moving the article A transversely along the length of the anvil 102 so that the joint portion of the tensioned loop slips off of the end of the anvil 102 and snaps into engagement with the article A.

A new length of strap 22 may then be fed forward into the gripper assembly 100. To this end, the solenoid actuator 78 (FIG.S. 2 and 3) is deenergized to permit the actuator internal spring mechanism (not illustrated) to effect a lowering of the back-up wheel 66 into engagement with the strap 22 on the traction wheel 50. The electric motor 62 is simultaneously energized to rotate the traction wheel 50 so as to feed the strap 22 forward a small amount to position the strap end portion over the anvil 102 as illustrated in FIG. 14A prior to initiating the next strapping cycle.

It will be readily observed from the foregoing detailed description of the invention and from the illustrated embodiment thereof that numerous variations and modifications may be effected without departing from the true spirit and scope of the novel concepts or principles of the invention.

What is claimed is:

1. A method for forming a loop of strap for encompassing an article, said method comprising the steps of:

(a) feeding a length of strap to orient a segment between two spaced-apart gripping members;

(b) gripping said strap segment with said gripping members by effecting relative movement between said gripping members to a clamping orientation to clamp said strap segment between said gripping members;

(c) while continuing step (b), moving both of said gripping members together in the clamping orientation in a closed path to form a primary loop in said strap around at least one of said gripping members; and (d) while continuing step (b), feeding said strap to expand said primary loop to an expanded loop having a larger size for accommodating said article.

2. The method in accordance with claim 1 in which step (b) includes gripping said strap segment inwardly of the distal end of said strap to leave an end portion projecting beyond said gripped segment.

3. The method in accordance with claim 2 in which said method further includes, after step (d), the following step (e):

(e) while continuing step (b), effecting relative movement between said article and said expanded loop to locate said expanded loop around said article.

4. The method in accordance with claim 3 in which said method further includes, after step (e), the following additional steps (f) and (g):

(f) tightening said expanded loop about said article; and (g) joining overlapping strap portions of the tightened loop, one of said overlapping portions being said projecting end portion.

5. The method in accordance with claim 4 in which step (g) includes fusing said overlapping strap portions with ultrasonic, thermal, or friction-fusion energy input.

6. The method in accordance with claim 1 in which step (c) includes rotating said gripping members in a generally circular path to form said primary loop and terminating said rotation after said primary loop is formed in an orientation hanging downwardly from said gripping members relative to the force of gravity.

7. The method in accordance with claim 1 in which step (a) includes feeding said strap in the form of a thin film.

8. The method in accordance with claim 1 in which said method further includes, after step (d), the following additional steps (f) and (g):

(f) placing said article in said expanded loop and tightening said expanded loop about said article; and (g) joining overlapping strap portions of the tightened loop.

9. The method in accordance with claim 8 in which said method further includes, after at least step (f), the additional step of severing the trailing portion of said strap from the tightened loop.

10. A method for forming a loop about an article with strap, said method comprising the steps of:

(a) feeding a length of strap to orient a segment of the strap in a gap between two gripping members wherein one of the gripping members is an anvil and the other of the gripping members is a gripper arm;

(b) biasing said anvil relative to, and toward, said gripper arm to clamp said strap segment between said gripper arm and said anvil;

(c) while continuing step (b), rotating said gripper arm with said biased anvil clamping said strap segment whereby a primary loop is formed in said strap around said anvil;

(d) while continuing step (b), feeding said strap to expand said primary loop to an expanded loop having a larger size for accommodating said article; and (e) while continuing step (b), effecting relative movement between said article and said expanded loop to locate said expanded loop around said article.

11. Apparatus for forming a loop of strap for encompassing an article with the loop, said apparatus comprising:

a frame and two gripping members mounted on said frame for movement together in a closed path;

means for effecting relative movement between said gripping members to a clamping orientation to clamp a segment of said strap between said gripping members;

means on said frame for moving said two gripping members together in said closed path, while fixed relative to each other in the clamping orientation with said strap segment clamped between said two gripping members, to form a primary loop in said strap around at least one of said gripping members; and strap drive means for feeding said strap to expand said primary loop to an expanded loop having a larger size for accommodating said article.

12. The apparatus in accordance with claim 11 in which said strap drive means also includes means for retracting said strap to tighten said expanded loop about said article.

13. The apparatus in accordance with claim 11 further including means for severing the trailing portion of the strap from said tightened loop.

14. The apparatus in accordance with claim 11 in which one of said two gripping members comprises a gripper arm on a first shaft that is mounted for rotation on said frame and the other of said two gripping members comprises an anvil on a second shaft that is mounted concentrically on said first shaft for rotation relative to said first shaft;

in which said means for effecting relative movement between said gripping members comprises a spring disposed between said first shaft and said second shaft for biasing said anvil relative to, and toward, said gripper arm to clamp said strap between said gripper arm and said anvil; and in which said means for moving said two gripping members together includes a motor drivably connected with said first shaft.

15. The apparatus in accordance with claim 14 in which:

said first shaft carries a first detent element;

said second shaft carries second and third detent elements; and said apparatus includes first, second, and third pawls pivotally mounted to said frame and first, second, and third biasing means for biasing said first, second, and third pawls, respectively, to engage said first, second, and third detent elements, respectively.

16. The apparatus in accordance with claim 15 further including a second pawl release means for pivoting said second pawl against said second biasing means and out of engagement with said second detent element.

17. The apparatus in accordance with claim 15 in which each said detent element comprises a cylindrical surface defining a notch.

18. The apparatus in accordance with claim 11 in which said strap drive means includes a traction wheel, means for rotating said traction wheel, and a back-up wheel for pressing said strap against said traction wheel.

19. The apparatus in accordance with claim 18 further including means for mounting said back-up wheel for movement toward and away from said traction wheel and further including means for effecting movement of said back-up wheel toward and away from said traction wheel.

20. Portable apparatus adapted to be placed on a generally planar support surface and operable for forming a tensioned loop of film strap around an article, said apparatus comprising:

a frame defining a generally planar base contact surface for being placed on said support surface;

gripping members mounted on said frame for movement together in a circular locus in a plane generally normal to said base contact surface, said gripping members being mounted at an elevation above said base contact surface to accommodate placement of said article between said gripping members and said support surface;

means for effecting relative movement between said gripping members to a clamping orientation to clamp a segment of said strap between said gripping members;

means on said frame for moving said two gripping members together in said circular locus, while fixed relative to each other in the clamping orientation with said strap segment clamped between said two gripping members, to form a primary loop in said strap around one of said gripping members; and strap drive means for feeding said strap to expand said primary loop in a generally downward direction to form an expanded loop having a larger size for accommodating placement of said article therein and having a portion of the loop resting on said support surface.

21. Apparatus for forming a loop of strap for encompassing an article with the loop, said apparatus comprising:

a frame and two gripping members mounted on said frame for movement together in a closed path, one of said two gripping members comprising a gripper arm on a first shaft that is mounted for rotation on said frame and the other of said two gripping members comprising an anvil on a second shaft that is mounted concentrically on said first shaft for rotation relative to said first shaft;

means for effecting relative movement between said gripping members to clamp a segment of said strap between said gripping members, said means for effecting relative movement between said gripping members comprising a spring disposed between said first shaft and said second shaft for biasing said anvil relative to, and toward, said gripper arm to clamp said strap between said gripper arm and said anvil;

means on said frame for moving said two gripping members together in said closed path with said strap segment clamped between said two gripping members to form a primary loop in said strap around at least one of said gripping members, said means for moving said two gripping members together including a motor drivably connected with said first shaft; and strap drive means for feeding said strap to expand said primary loop to an expanded loop having a larger size for accommodating said article.

22. The apparatus in accordance with claim 21 in which:

said first shaft carries a first detent element:

said second shaft carries second and third detent elements; and said apparatus includes first, second, and third pawls pivotally mounted to said frame and first, second, and third biasing means for biasing said first, second, and third pawls, respectively, to engage said first, second, and third detent elements, respectively.

23. The apparatus in accordance with claim 22 further including a second pawl release means for pivoting said second pawl against said second biasing means and out of engagement with said second detent element.

24. The apparatus in accordance with claim 22 in which each said detent element comprises a cylindrical surface defining a notch.

25. Apparatus for forming a loop of strap for encompassing an article with the loop, said apparatus comprising;

a frame and two gripping members mounted on said frame for movement together in a closed path;

means for effecting relative movement between said gripping members to clamp a segment of said strap between said gripping members;

means on said frame for moving said two gripping members together in said closed path with said strap segment clamped between said two gripping members to form a primary loop in said strap around at least one of said gripping members; and strap drive means for feeding said strap to expand said primary loop to an expanded loop having a larger size for accommodating said article, said strap drive means including a traction wheel, means for rotating said traction wheel, and a back-up wheel for pressing said strap against said traction wheel.

26. The apparatus in accordance with claim 25 further including means for mounting said back-up wheel for movement toward and away from said traction wheel and further including means for effecting movement of said back-up wheel toward and away from said traction wheel.

* * * * *